United States Patent [19]

Mather et al.

[11] 4,440,665

[45] * Apr. 3, 1984

[54] CONCENTRATED AQUEOUS SURFACTANT COMPOSITIONS

[75] Inventors: Douglas E. Mather, Whitehaven; Edward T. Messenger, Workington; Brinley M. Phillips, Whitehaven, all of England

[73] Assignee: Albright & Wilson Limited, Warley, England

[ * ] Notice: The portion of the term of this patent subsequent to Jan. 6, 1998 has been disclaimed.

[21] Appl. No.: 42,351

[22] Filed: May 25, 1979

[30] Foreign Application Priority Data

May 26, 1978 [GB] United Kingdom ..... 22991/78

[51] Int. Cl.[3] ..... B01F 17/28; C11D 3/33

[52] U.S. Cl. ..... 252/356; 252/542; 252/546; 252/DIG. 7; 252/DIG. 14

[58] Field of Search ..... 252/356, DIG. 7, DIG. 14, 252/527, 546

[56] References Cited

U.S. PATENT DOCUMENTS 4,243,549 1/1981 Messenger et al. ..... 252/357 X

*Primary Examiner*—Richard D. Lovering

*Attorney, Agent, or Firm*—Frishauf, Holtz, Goodman & Woodward

[57] ABSTRACT

Aqueous surfactant mixtures comprising a first amphoteric surfactant and at least one non-ionic surfactant and/or at least one amphoteric surfactant non-homologous with the first amphoteric surfactant, are obtained at a concentration substantially higher than previously obtainable by preparing them in the presence of sufficient water to form a "G" phase.

10 Claims, No Drawings

CONCENTRATED AQUEOUS SURFACTANT COMPOSITIONS

The present invention relates to novel concentrated aqueous surfactant compositions, which comprise mixtures of different surfactants.

Mixtures of surfactants are prepared and sold for a wide variety of industrial and domestic applications. They are often required in a fluid form, and it is desirable that they should contain as high a proportion of active material as possible, in order to reduce the costs of storage and transport.

Where the mixture has a melting point below, or only slightly above ambient temperature it is sometimes possible to supply the composition in the form of an anhydrous mixture, or a mixture containing up to about 5% of water, respectively. In the latter case the trace of water appears to act as a melting point depressor.

However, in the case of most surfactant mixtures which are sold at temperatures above about 25° C., it has generally been impossible to obtain a fluid composition at concentrations above about 30 to 50% by weight of active ingredient, depending on the nature of the mixture. Small amounts of water up to about 10% do not depress the melting point sufficiently, while larger amounts, sufficient to cause a phase change result in the formation of a rigid gel, rather than a fluid solution. It has generally been found that as the total concentration of surface active ingredient in a dilute solution approaches a critical level, which is usually about 30% by weight but may in the case of some mixtures be higher, e.g. up to about 55% by weight, the viscosity of the solution begins to rise, causing difficulty in preparing and handling the solution. At the critical level the solution sets into an immobile gel or phase separation occurs.

It is sometimes possible to increase the concentration of active ingredient by addition of viscosity modifiers or cosolvents, such as alcohols, which act as thinners, both lowering the viscosity of the solution and inhibiting the formation of gels, so that higher concentrations may be attained. Such cosolvents are normally only effective in producing substantial increases in the attainable concentration when they are present in relatively large amounts. Some solvents constitute a fire hazard at these concentrations, and most adversely affect the properties of the product for many of its desired end uses and/or increase the cost of the product.

The term "active concentration" will be used herein to denote the total concentration of "active" (i.e. surface active) material in the aqueous composition.

It has been reported (see for example "Advances in Colloid Interface Science" 1 (1967)79–110 pp. 82–83) that some surfactant compounds are capable of forming highly viscous, non-pumpable liquid crystal phases. Some of these compounds form a phase of relatively low viscosity compared with the other liquid crystal phases, which is usually referred to as the "G" or "lamellar phase" and which forms only within a specific active concentration range. However, in most instances, including the case of virtually all those compounds which are of industrial interest, where the existence of a "G" phase has been reported, it can only be formed at elevated temperatures. Thus, for example, sodium lauryl sulphate has been reported to form a "G" phase, at about 74° C. which is pourable. However, due to the elevated temperature required this phenomenon has hitherto been regarded as having purely academic interest. There has been no recognised industrial application of this phenomenon. Moreover, it has never been reported that mixtures of different kinds of surfactant are capable of forming a "G" phase.

Recently, we have discovered that certain surfactants of commercial value including some ammonium alkyl sulphates and some olefin sulphonates form "G" phases at ambient temperature. As a consequence of this discovery we are now able to prepare these surfactants in a fluid form at very much higher concentrations than could previously have been achieved. (See for example our copending British patent application Nos. 2038/74 and 1745/75.)

We have now discovered that certain mixtures of surfactants form a fluid lamellar (G) phase within a narrow range of concentrations lying above the concentration at which the immobile phase forms. This range often lies above 60% active concentration and may be as high as 80%; it may only extend over a very narrow concentration range of within ±2 to 5% of the viscosity minimum.

The mixtures tend to form fluid "G" phases at relatively low temperatures compared with the typical minimum temperatures at which aqueous solutions of most individual surfactants which are capable of forming "G" phases can exist in such a phase. Usually the mixtures can be obtained as a fluid "G" phase at ambient temperatures or by slight warming.

By preparing solutions of such mixtures at the particular active concentration corresponding to the formation of the "G" phase we have been able to obtain pumpable mixtures of surfactants at active concentrations which are in some cases more than double the maximum which has hitherto been attainable. This gives rise to substantial savings in the cost of transporting and storing the products. It has also been discovered that the more highly active compositions of our invention have bacteriostatic properties.

The compositions are, generally, unexpectedly easy to dilute back to conventional dilutions, in comparison with single component surfactants and, in many instances, show little tendency to form an intermediate gel phase on addition of sufficient water to effect such dilution.

The invention provides an aqueous surfactant composition consisting substantially of at least 20% and not more than 55% (preferably not more than 45%) by weight of water and active mixture consisting of at least 5%, by weight of said mixture of a first, amphoteric surfactant with at least 5%, by weight of said mixture, of at least one nonionic surfactant and/or at least one amphoteric surfactant non-homologous with said first amphoteric surfactant, said mixture in the presence of water exhibiting a "G" phase and the concentration of said mixture corresponding to that at which the composition can exist, at least predominantly in the "G" phase.

The "G" phase is a pumpable fluid which is formed over a narrow range of concentrations which range usually lies somewhere within the broad range 45% to 80% by weight of active ingredient and is characterised by a lamellar structure in which the surfactant molecules are associated to form plates of indefinite size separated by planes of water molecules.

Typically when a surfactant mixture having a composition corresponding to the active ingredients according to the invention is prepared in aqueous solutions of increasing concentration, the molecules are first found to associate in spherical clusters (micelles), which with increasing concentrations become rod-like. At higher concentrations the micelles become more crowded causing a rise in the viscosity of the solution and, in the great majority of cases, eventually lengthen to form a regular hexagonal array of cylindrical surfactant micelles in an aqueous medium (the rigid "$M_1$" liquid crystal phase). If the concentration of a surfactant in the "$M_1$" phase is progressively increased a phase change occurs to give either a hydrated solid phase, or, in the case of surfactant mixtures of this invention, to convert the $M_1$ phase progressively to a fluid "G" phase until a viscosity minimum is reached. Further increase in the concentration of the "G" phase causes the viscosity to rise until a further phase change occurs. This may lead to the formation of either a hydrated solid or a second immobile liquid crystal phase (the $M_2$ phase) which resembles the $M_1$ phase in structure, but inverted—i.e. with water as the internal phase and the surfactant as the continuous phase.

The foregoing description is somewhat simplified. The term "hydrated solid phase" has been used broadly to include those systems which comprise suspensions of solid or immobile gel phases in one or more viscous or gel phase to provide a more or less rigid material usually having a granular appearance under a polarising microscope. No one surfactant has been found which will form all of the various liquid crystal phases, however, surprisingly, all the mixtures of the classes of surfactant specified herein we have so far examined form a fluid "G" phase, even in cases where the individual components do not form "G" phases or form them only with difficulty, e.g. at high temperatures.

In general we have found, to a good approximation, that the proportion of an n component active mixture required to form a "G" phase can be determined from the formula:

$$\frac{C_1}{g_1} + \frac{C_2}{g_2} + \ldots \frac{C_n}{g_n} = 1,$$

where $C_1 \ldots C_n$ are the concentrations of the individual active components and $g_1 \ldots g_n$ are, respectively, the concentrations at which each component forms a "G" phase of minimum viscosity. This formula enables the concentration of the mixture corresponding to the minimum viscosity "G" phase to be estimated in a majority of cases. Where g is not known, or a component does not form a "G" phase, or the above formula is not applicable, then any "G" phase can be located very rapidly and easily, using standard laboratory equipment by making a test composition having an active concentration of say 75% (or, where appropriate, whatever concentration has been estimated on the basis of the foregoing formula) and placing a sample on a slide on the block of a heated stage microscope. Examination between crossed polarisers will reveal in which phase the sample is present. The various phases each have a characteristic appearance which is easily identified by comparison for example with the photographs of typical liquid crystal phases in the classic paper by Rosevear, JAOCS Vol. 31 P 628 (1954) or in J. Colloid and Interfacial Science, Vol. 30 No. 4 P. 500.

If the mixture is in an $M_1$ phase, water may be allowed to evaporate from the edges of the sample under the cover disk and any phase changes observed. If an $M_2$ phase or hydrated solid is present water may be added around the edge of the cover disks and allowed to diffuse into the composition. If no "G" phase is located in this way samples may be heated progressively on the block and the operation repeated.

Usually the composition is pumpable at concentrations within a range of ±10%, preferably ±5%, e.g. ±2.5% of the minimum viscosity concentration. This range tends to be broader at more elevated temperatures. Compositions may be obtained, at the limits of the range in which one or more solid or gel phase is suspended in a continuous "G" phase. Such compositions are often useful on account of their appearance and constitute a particular aspect of the invention.

Typically the compositions of the invention contain two, three or four different kinds of surfactant each in a concentration of more than 10% by weight of the composition.

The composition of our invention may contain minor amounts of non-surfactant organic solvents, such as glycols, or fatty alcohols, and of non-colloidal electrolytes such as sodium chloride, or sulphate. Such inclusions are often present as impurities in the surfactants. However we prefer not to add appreciable amounts of solvents to the compositions of our invention. We prefer where possible to maintain the proportion of non-surfactant organic solvent below 5% by weight of the active mixture and preferably below 5% by weight of the total composition. Most preferably the proportion is less than 2% by weight of the total composition, e.g. less than 1%. The presence of inorganic salts or similar non-colloidal electrolytes also has some substantial disadvantages. In particular because it lowers the maximum attainable concentration of the fluid "G" phase and in the case of chloride may cause corrosion problems.

Electrolytes also raise the viscosity of the product when it is diluted to its working concentration by the detergent formulator or other industrial purchaser. Although this may sometimes be desirable, it is preferable for the formulator to have the option to control the viscosity of his product by adding electrolyte or not, according to his requirements. This option is restricted if electrolyte is already present. We therefore prefer, generally that the proportion of non-surface active electrolyte be maintained within the same limits as those stated in relation to organic solvents.

The composition of our invention may optionally contain minor amounts, e.g. up to 5% by weight of the active mixture, of surface active material other than those specified hereinbefore.

The active mixtures in the compositions of our invention comprise at least one amphoteric surfactant. The amphoteric surfactant may for example be a betaine, e.g. a betaine of the formula:

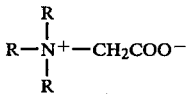

wherein each R is an alkyl, cycloalkyl, alkenyl or alkaryl group and preferably at least one and most preferably not more than one R has an average of from 8 to 20 e.g. 10 to 18 aliphatic carbon atoms and each other R has an average of from 1 to 4 carbon atoms. Particularly preferred are the so called quaternary imidazoline betaines commonly ascribed the formula:

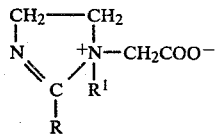

wherein R and $R^1$ are alkyl, alkenyl, cycloalkyl, alkaryl or alkanol groups having an average of from 1 to 20 aliphatic carbon atoms and R preferably has an average of from 8 to 20 e.g. 10 to 18 aliphatic carbon atoms and $R^1$ preferably has 1 to 4 carbon atoms. Other amphoteric surfactants for use according to our invention include alkyl amine ether sulphates, sulphobetaines and other quaternary amine and other quaternary amine or quaternised imidazoline carboxylic acids and their salts, and unquaternised amino acids, having in each case hydrocarbon groups capable of conferring surfactant properties (e.g. alkyl, cycloalkyl, alkenyl or alkaryl groups having from 8 to 20 aliphatic carbon atoms). Typical examples include $C_{12}H_{25}N^+(CH_3)_2CH_2COO^-$ and $RNHCH_2COOH$.

As used herein "amphoteric surfactant" includes any water soluble surfactant compound which comprises a hydrophobic portion including a $C_{8-20}$ alkyl or alkenyl group, and a hydrophilic portion containing both a cationic or cation forming group (such as an amine or quaternary ammonium or similar basic group) and an anionic or anion forming group (such as carboxylate, carboxylic acid, sulphate, sulphuric acid, sulphonate, or sulphonic acid groups). "Non-ionic surfactant" includes semi-polar surfactants such as amine oxides.

The compositions of our invention preferably contain at least 10% of the amphoteric surfactant based on the weight of active mixture most preferably at least 20%, e.g. at least 30%. The mixtures additionally contain at least one non-ionic surfactant and/or at least one other amphoteric surfactant non-homologous with the first. The non-ionic surfactant is typically a polyalkoxylated fatty alcohol, fatty acid, alkyl phenol, glyceryl ester, sorbitan ester or alkanolamide, wherein, in each case there is an alkyl group containing an average of from 8 to 22, preferably 10 to 20 carbon atoms and a polyalkylene oxy group, usually containing an average of from 1 to 20, e.g. 3 to 10 alkylene oxy units. The alkyleneoxy units are normally ethylenoxy units, but the group may also contain some propyleneoxy units. The alkyl and alkoxylated alkyl amine oxides having at least one alkyl group with an average of from 8 to 22 carbon atoms are also included among the non-ionic surfactants which are suitable for use in our invention. The non-ionic surfactant may be present in a total proportion of up to 95% of the weight of active mixture, preferably 10 to 75% most preferably 15 to 50%, e.g. 20 to 45%.

It will be understood that the various surfactants referred to herein will each, in practice, normally be mixtures of close homologs so that the figures quoted for the size of the alkyl or polyoxyalkylene groups are in each case averages. Homologs, in the context of this specification, means molecules differing only in respect of the number of carbon atoms in their respective alkyl groups, and/or the number of alkylenoxy or other repeating monomer units in a polyalkyleneoxy or similar polymeric chain.

The compositions of our invention may be prepared by mixing the individual surfactants in the presence of the correct proportion of water to obtain the product in the "G" phase. Where all the active components form a "G" phase it is often convenient to prepare each active component separately in the "G" phase, e.g. by preparing it in the presence of the calculated amount of water, and then mix the components. Where one component only forms a "G" phase at an elevated temperature, that component may be prepared and blended with the other component at approximately elevated temperatures to ensure that both components are in a pumpable state. Where one component does not form a "G" phase, or forms it only with difficulty and the other component forms a "G" phase more readily it is often convenient to prepare the second component in the "G" phase and prepare the first component in the presence of the second, adding water at a rate sufficient to maintain the whole composition in the "G" phase. Another method which may be convenient when none of the individual components forms a "G" phase sufficiently readily, is to prepare the mixture directly from a mixture of the precursors of the individual surfactants, in the presence of sufficient water to maintain the product in the "G" phase. It is also possible to prepare the active mixture in a form other than the "G" phase and adjust the water content by evaporation from, or diffusion into the mixture. This last method is not, however, always practicable on an industrial scale.

The invention is illustrated by the following examples:

EXAMPLE 1

A mixture comprising:

170 g of a 30% solution of $C_{12/14}$ alkyl dimethylamine betaine (containing 7.5% sodium chloride), 30 g of a commercial lauric diethanolamide (containing 90% lauric diethanolamide), was evaporated to give a total weight of 115.4 g. The composition of the mixture was calculated to be:

| | |
|---|---|
| 44% | Betaine |
| 23.4% | Lauric diethanolamide |
| 11.0% | NaCl |
| 2.5% | By-products from lauric diethanolamide |
| 19.0% | Water |

and had a total surfactant concentration of 67.4%. The mixture was a fluid lamellar liquid identified as "G" phase.

EXAMPLE 2

It was desired to prepare a 1:1 mixture of betaine (tallow/coconut amido propyl (dimethyl) aminoacetate, $RCONHCH_2CH_2CH_2(CH_3)_2N^+CH_2COO$, (hereinafter called BT) with lauric diethanolamide $RCON/CH_2CH_2OH)_2$, (hereinafter referred to as LD).

BT is normally prepared by reacting the amido amino precursor $RCONHCH_2CH_2CH_2N(CH_3)_2$, hereinafter called AT, with sodium chloroacetate in aqueous solution.

$$RCONHCH_2CH_2CH_2N(CH_3)_2 + Cl\,CH_2COONa \rightarrow RCONH(CH_3)_3N(CH_3)_2CH_2COO$$

Typically BT is prepared and sold at about 30% by weight concentration. The maximum concentration at which BT can be prepared in water as a pumpable solution is about 35% by weight.

LD is normally available commercially at about 90% active concentration, together with methyl esters, amines and ester amines as impurities.

Equimolar amounts of the commercially available products blended provide a maximum possible active concentration of 50%. However, we have discovered, by evaporating down a 50% mixture, that a pourable "G" phase can be obtained at active concentrations of 60 to 64% by weight. To prepare such a composition by blending would require a 45 to 50% by weight aqueous solution of BT, which is an intractable, immobile gel.

A.

A 1 liter jacketed reaction vessel with stirring and recycle facilities was charged with 335 g AT (91%, 1 mol) and 400 g LD (90%). The mixture was warmed to 65° C. and a solution of 104 g chloroacetic acid (1.1 m) in 284 g water was added over 2½ hours maintaining the pH at 7.5±0.5, by the addition of 47% sodium hydroxide solution. The reaction was continued for a further 12 hours at pH 7.5±0.5, at 65° C. when the free amido amine was found to be 0.9%. The product was a mobile "G" phase, having a total active concentration of 60%.

B.

A 10 liter jacketed reactor with stirring and recycle facilities was charged with a solution of 808 g chloracetic acid in 1831 g water. A mixture of 2774 g LD (90%) and 2359 g of glycerol-free AT (89% amido amine) was then charged with stirring. The resulting mobile mixture was heated to 65° C. and recycled to improve mixing. The pH was raised to, and maintained at, 7.5–8.0 by the addition of 47% sodium hydroxide solution, and the temperature was maintained at 65° C. After 17 hour reaction the free amido amine was found to be 1.5%. The final product was a mobile "G" phase having a total active concentration of 60%.

Composition of Formulation

Both the BT and LD contained some impurities, and the approximate composition of the formulation prepared according to Example 1A is given below:

| | |
|---|---|
| Amido Amine betaine | 30% |
| Lauric Diethanolamide | 30% |
| Amine esters, etc. | 3% |
| Glycerol | 3% |
| Amido amine | 1–2% |
| NaCl | 5–6% |
| $H_2O$ | 27% |

In example 1B the AT had been washed to remove the glycerol and in the final product the glycerol was replaced by water.

EXAMPLE 3

A stirred jacketed flask, equipped with a means of recycling material from the bottom to the top of the flask, was charged with 588 g of 90% pure lauric diethanolamide. The lauric diethanolamide was heated to 60° C., and 442 g of a $C_{12/14}$ alkyl dimethylamine having a molecular weight of 221 was added over a 20 min. period together with sufficient quantity of a solution of 208 g chloroacetic acid in 290 g water to maintain the pH in the range 7–8. The remainder of the chloracetic acid solution was then added maintaining the pH in the range 7–8 by the addition of 47% sodium hydroxide solution.

The pH of the mixture was raised to 8.5, and the temperature was increased to 65° C., and the reaction was maintained under these conditions for a further 9 hrs., when no further sodium hydroxide solution was required to maintain a constant pH, indicating that quaternisation was substantially completed. Approximately 216 g of 47% sodium hydroxide solution was required in this preparation.

In this example a betaine was prepared in the presence of lauric diethanolamide, and the blend had a total surfactant concentration of 66% in a weight ratio of 1:1 amphoteric:nonionic surfactant and was a mobile liquid identified as "G" phase throughout the reaction.

EXAMPLE 4

A stirred jacketed flask, equipped with a means of recycling material from the bottom to the top of the flask was charged with 472 g of a 72% solution of a $C_{12/14}$ amine oxide, derived from an ethoxylated alcohol. The amine oxide is represented by the formula:

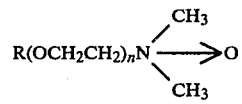

where the average value of n=3.

The solution which was in the "G" phase was heated to 50° C., and 276 g of a $C_{12/14}$ alkyl dimethylamine (molecular weight=221) was added together with a sufficient quantity of a solution of 124.8 g chloroacetic acid in 19.8 g water at 60° C. to maintain the pH in the range 8.5–9.0. The remainder of the chloroacetic acid solution was then added maintaining the pH in the range of 8.5–9.0 by the addition of 57% sodium hydroxide solution to maintain a constant pH, indicating that quaterisation was substantially complete. Approximately 92.5 g of 57% sodium hydroxide solution was required in this preparation.

In this example a betaine was prepared in the presence of an amine oxide, and the blend had a total surfactant concentration of 69% in a weight ratio of 1:1 nonionic:amphoteric surfactant, and the material was a mobile liquid identified as G phase, through the reaction.

EXAMPLE 5

A stirred jacketed flask, equipped with a means of recycling material from the bottom to the top of the flask was charged with 473.7 of 90% pure coconut diethanolamide. The material was heated to 60° C. and 377 g of an amido amine of the formula:

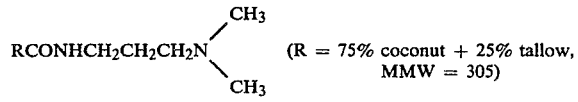

was added. A solution of 122.7 g chloroacetic acid in 200 g water was then added, maintaining the pH in the range 8–8.5 by the addition of 47% sodium hydroxide solution. The temperature was then raised to 65° C. and the pH maintained in the range 8–8.5 for a further 8 hrs., when it was found that no further sodium hydroxide solution was required to maintain a constant pH indicating that quaternisation was complete. Approximately 101 g 47% sodium hydroxide solution was required in this preparation.

In this example an amido amine betaine was prepared in the presence of coconut diethanolamide, and the blend had a total surfactant concentration of 69% in a weight ratio of 1:1 amphoteric:nonionic surfactant, and was a mobile liquid identified as G phase throughout the reaction.

EXAMPLE 6

A stirred jacketed flask, equipped with a means of recycling material from the bottom to the top of the flask was charged with 400 g of 90% pure coconut diethanolamide. The material was heated to 60° C. and 305 g of a $C_{12/14}$ alkyl dimethylamine (Molecular weight=221) was charged over 15 mins. A solution of 14 ag chloracetic acid in 113 g water was added maintaining the pH at 8–8.5 by the addition of 47% sodium hydroxide. The temperature was increased to 65° C., and the pH was maintained at 8–8.5 for a further 6 hrs., when no further sodium hydroxide was required to maintain a constant pH, indicating that quaternisation was complete. In this preparation approximately 130 g 47% sodium hydroxide was required.

In this example a betaine was prepared in the presence of coconut diethanolamide, and the blend had a total surfactant concentration of 68% in a weight ratio of 2:1 of nonionic:amphoteric surfactant, and the mixture was a mobile liquid identified as G phase throughout the reaction. To prepare this blend by mixing a solution of the betaine with coconut diethanolamide would require a betaine concentration of 56%, and at this concentration the material is a highly viscous gel identified as $M_1$ phase.

EXAMPLE 7

A stirred jacketed flask, equipped with a means of recycling material from the bottom to the top of the flask, was charged with 588 g of 90% pure lauric diethanolamide. The lauric diethanolamide was heated to 60° C., and 221 g of a $C_{12/14}$ alkyl dimethylamine having a molecular weight of 221 was added over a 10 min. period. A solution of 138 g chloracetic acid in 127 g was added over ½ hour maintaining the pH in the range 7–8 by the addition of 47% NaOH solution.

The pH of the mixture was raised to 8.5, and the temperature was increased to 65° C., and the reaction was maintained under these conditions for a further 9 hrs., when no further sodium hydroxide solution was required to maintain a constant pH, indicating that quaternisation was substantially complete. On analysis the blend was found to contain 0.1% unreacted amine. Approximately 153 g of 47% sodium hydroxide solution was required in this preparation.

In this example a betaine was prepared in the presence of lauric diethanolamide and the blend had a total surfactant concentration of 66% in a weight ratio of 1:2 amphoteric:nonionic surfactant and w as a mobile liquid identified as G phase throughout the reaction.

We claim:

1. An aqueous surfactant composition consisting essentially of at least 20% but not more than 55% by weight of water, and an active mixture consisting of at least 5% by weight of said mixture, of a first, amphoteric surfactant with at least 5% by weight of said mixture of at least 1 surfactant selected from the group consisting of nonionic surfactants and amphoteric surfactants non-homologous with said first amphoteric surfactant, said mixture being capable of forming a "G" phase in the presence of water and the concentration of active ingredient in said composition corresponding to that at which the composition can exist, at least predominantly in the "G" phase.

2. A composition according to claim 1 having n active components which are each capable of forming a "G" phase with water at concentrations respectively of $g_1 \ldots g_n$ and which are present in the composition respectively at concentrations of about $c_1 \ldots c_n$ such that $$\frac{C_1}{g_1} + \frac{C_2}{g_2} + \ldots \frac{C_n}{g_n} = 1$$

3. A composition according to either of claims 1 and 2 wherein the graph of viscosity against the concentration of active mixture in water exhibits a minimum value corresponding to the formation of the "G" phase and wherein the proportion of active mixture present in the composition corresponds to about the minimum value.

4. A composition according to claim 1 wherein at least 2 different non-homologous active components which are present in proportions of more than 10% by weight of the composition.

5. A composition according to claim 1 containing less than 5% by weight of non-surfactant organic material based on the weight of the active mixture.

6. A composition according to claim 5 containing less than 2% of non-surfactant active material based on the total weight of the composition.

7. A composition according to claim 1 essentially free from non-surfactant organic solvent.

8. A composition according to claim 1 containing less than 5% of non-colloidal electrolyte based on the weight of the active mixture.

9. A composition according to claim 8 containing less than 2% by weight of non-colloidal electrolyte based on the weight of the total composition.

10. A composition according to claim 1 substantially free from added, non-colloidal electrolyte.

* * * * *